US010315317B2

(12) United States Patent
Votolato et al.

(10) Patent No.: US 10,315,317 B2
(45) Date of Patent: Jun. 11, 2019

(54) BLADE CARTRIDGES AND LOCKABLE SAFETY COVERS

(71) Applicant: Spellbound Development Group, Inc., Newport Beach, CA (US)

(72) Inventors: Earl J. Votolato, Newport Beach, CA (US); David Andrew Sharbaugh, Irvine, CA (US); Frank Matthew Howa, Mission Viejo, CA (US); Ryan Burkes, Huntingdon Beach, CA (US)

(73) Assignee: Spellbound Development Group, Inc., Newport Beach, CA (US)

( * ) Notice: Subject to any disclaimer, the term of this patent is extended or adjusted under 35 U.S.C. 154(b) by 160 days.

(21) Appl. No.: 14/931,093

(22) Filed: Nov. 3, 2015

(65) Prior Publication Data

US 2017/0120462 A1 May 4, 2017

(51) Int. Cl.
*B26B 5/00* (2006.01)
*B26B 29/02* (2006.01)

(52) U.S. Cl.
CPC ..... *B26B 5/00* (2013.01); *B26B 29/02* (2013.01)

(58) Field of Classification Search
CPC ..... B26B 5/00; B26B 5/001; B26B 5/002; B26B 5/003; B26B 5/006; B26B 29/00; B26B 29/02
USPC ..... 30/151
See application file for complete search history.

(56) References Cited

U.S. PATENT DOCUMENTS 1,426,184 A * 8/1922 Hammar ..... A22B 3/10 30/286
3,781,988 A * 1/1974 Jones ..... B26B 27/005 30/2
4,157,616 A * 6/1979 Lundqvist ..... B26B 27/007 294/25
4,531,286 A * 7/1985 Vito ..... B26B 29/02 30/143
4,980,977 A * 1/1991 Matin ..... B26B 29/02 30/151
5,478,346 A * 12/1995 Capewell ..... A61B 17/3215 30/151
5,522,135 A 6/1996 Votolato
5,676,677 A * 10/1997 Landis ..... A61B 17/3211 30/162
5,765,289 A * 6/1998 Schulz ..... B26B 29/02 30/292

(Continued)

FOREIGN PATENT DOCUMENTS

CA 2499895 C 5/2010
CA 2746710 A1 7/2010
WO 2010078007 A2 7/2010

OTHER PUBLICATIONS

Notice of Ex Parte Reexamination, U.S. Pat. No. 6,718,840, filed Oct. 7, 2010.

*Primary Examiner* — Jason Daniel Prone
*Assistant Examiner* — Richard D Crosby, Jr.
(74) *Attorney, Agent, or Firm* — Fish IP, Law

(57) ABSTRACT

Apparatuses, systems, and methods in which a utility knife includes a blade cover that is movable from a locked position to an unlocked position relative to at least one of a blade cartridge, a blade holder, and a tool handle are provided. When the blade cover is in an unlocked position, the blade cover can advantageously be moved from a blade covering configuration to a blade exposing configuration.

10 Claims, 4 Drawing Sheets

(56) References Cited

U.S. PATENT DOCUMENTS 5,852,874 A * 12/1998 Walker ..... B26B 27/005 30/2
5,933,918 A * 8/1999 Wallays ..... A47J 45/071 16/114.1
6,029,355 A 2/2000 Carlin
6,032,371 A 3/2000 Chou
6,178,640 B1 * 1/2001 Votolato ..... B26B 27/005 30/2
6,282,794 B1 9/2001 Cho et al.
6,493,945 B1 12/2002 DeRosa et al.
D469,001 S 1/2003 Branson, Jr.
6,510,611 B2 * 1/2003 Edwards ..... H02G 1/1229 30/90.1
6,560,873 B1 * 5/2003 Ortner ..... B26B 29/02 30/2
6,857,192 B1 2/2005 Summers et al.
D521,844 S 5/2006 Kempker et al.
7,082,688 B2 * 8/2006 Votolato ..... B26B 5/001 30/2
D527,604 S 9/2006 Kempker et al.
D571,180 S 6/2008 Marshall
7,475,480 B2 1/2009 Votolato
7,509,742 B2 * 3/2009 Votolato ..... B26B 5/00 30/151
7,533,595 B2 5/2009 Domenico
D605,055 S 12/2009 Benson
7,624,507 B2 12/2009 Bergstrand
7,870,675 B1 1/2011 Della Polla
D636,248 S 4/2011 Still
8,046,922 B2 * 11/2011 Eby ..... B26B 29/02 30/151
8,099,868 B1 * 1/2012 Votolato ..... B26B 5/00 30/2
D660,674 S 5/2012 Still
D660,675 S 5/2012 Gringer et al.
8,209,870 B2 7/2012 Votolato et al.
D673,440 S 1/2013 Kempker et al.
8,347,509 B2 1/2013 Votolato
D682,065 S 5/2013 Gringer et al.
8,677,629 B2 * 3/2014 Logan ..... B26B 29/02 30/151
8,732,956 B2 * 5/2014 McGushion ..... B26B 29/02 30/151
D714,611 S 10/2014 Yu Chen
8,857,064 B2 * 10/2014 Schmidt ..... B26B 5/001 30/162
8,869,408 B2 10/2014 Votolato
D752,942 S 4/2016 Rohrbach
9,346,177 B2 5/2016 Mayes
D767,966 S 10/2016 Standlee
D767,967 S 10/2016 Standlee
2002/0124412 A1 9/2002 Votolato
2004/0154167 A1 8/2004 Yu Chen
2005/0086811 A1 * 4/2005 Kawasaki ..... B26B 29/00 30/162
2005/0217114 A1 * 10/2005 Votolato ..... B26B 29/02 30/2
2006/0048389 A1 3/2006 Votolato
2007/0068000 A1 * 3/2007 Onion ..... B26B 1/02 30/160
2008/0010839 A1 * 1/2008 Eby ..... B26B 25/005 30/319
2009/0151168 A1 6/2009 Dadam
2009/0271988 A1 * 11/2009 Votolato ..... B26B 5/003 30/158
2010/0263217 A1 10/2010 Baxter et al.
2010/0263219 A1 10/2010 Kempker et al.
2011/0167646 A1 7/2011 Schmidt
2013/0298409 A1 11/2013 Jacobs et al.
2014/0345146 A1 11/2014 Schekalla
2015/0298330 A1 10/2015 Yu Chen
2015/0336283 A1 11/2015 Davis
2017/0120469 A1 5/2017 Votolato et al.

* cited by examiner

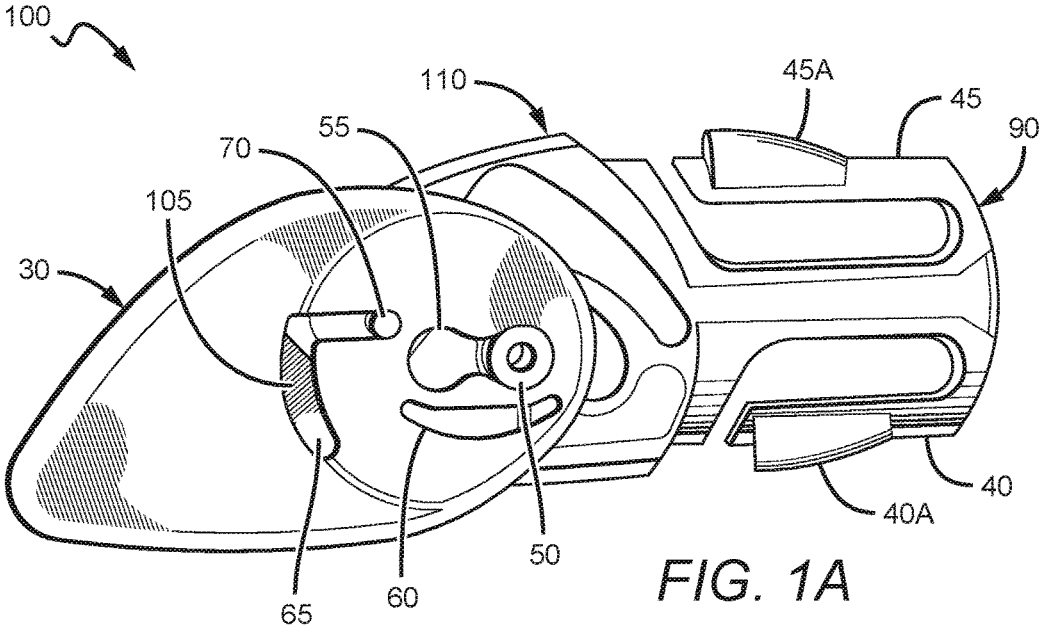
FIG. 1A
FIG. 1B
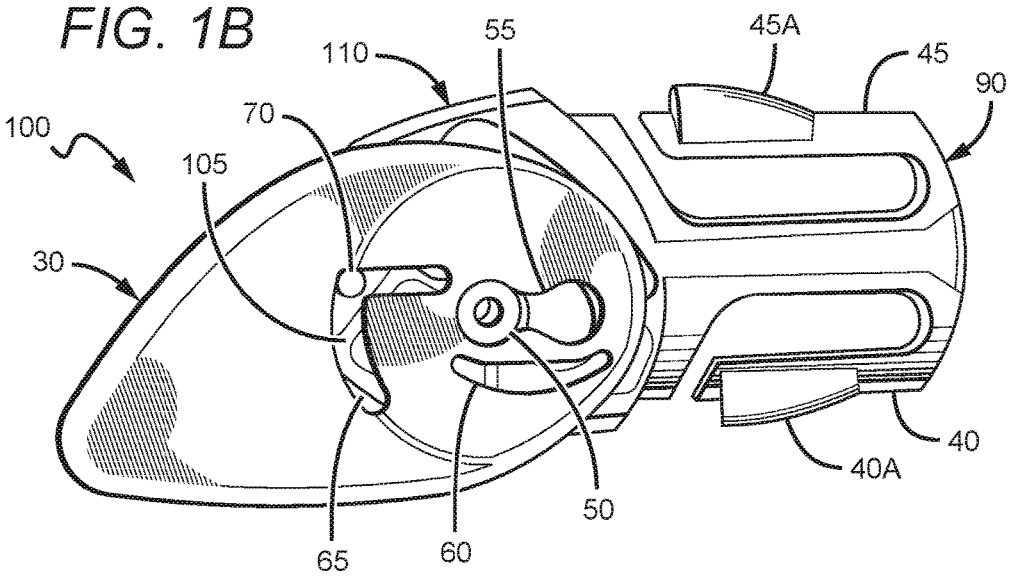

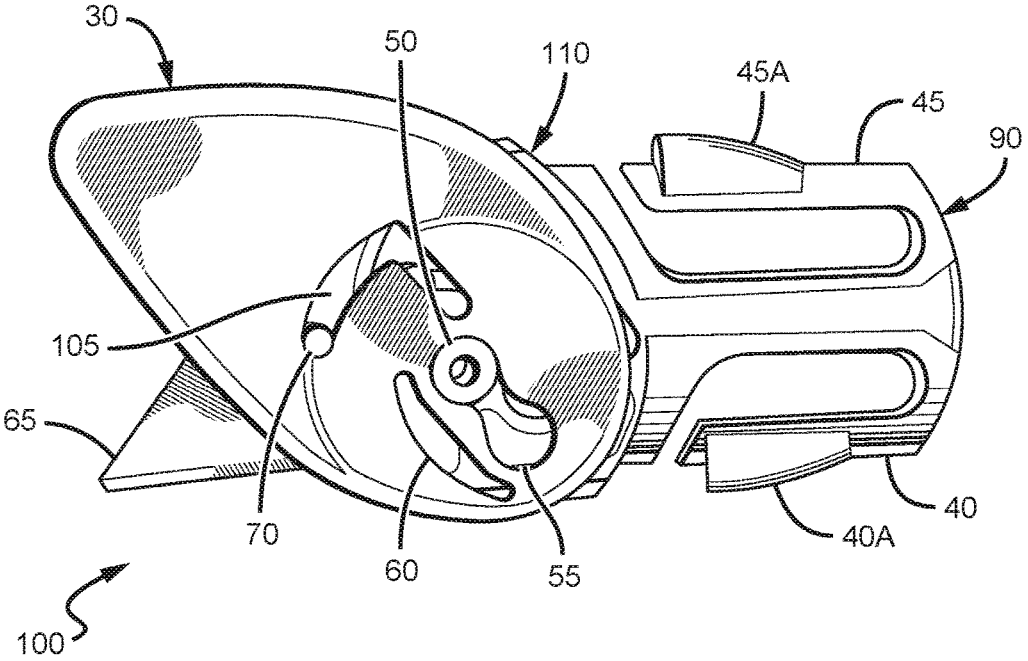
FIG. 1C
FIG. 2A
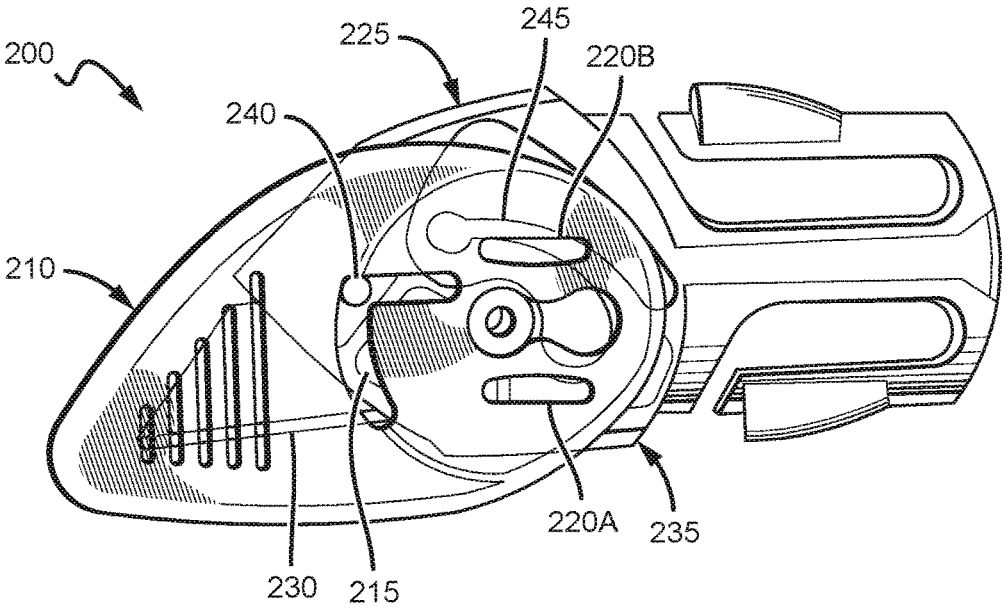

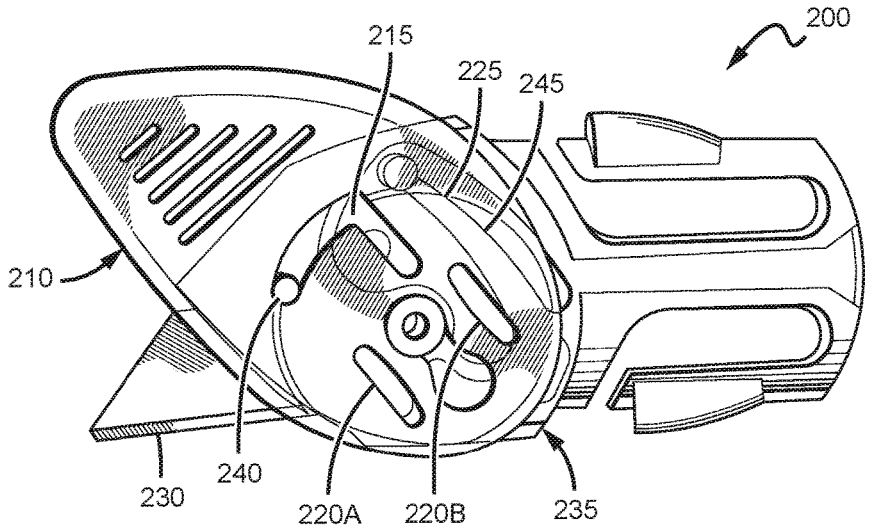
FIG. 2B
FIG. 3
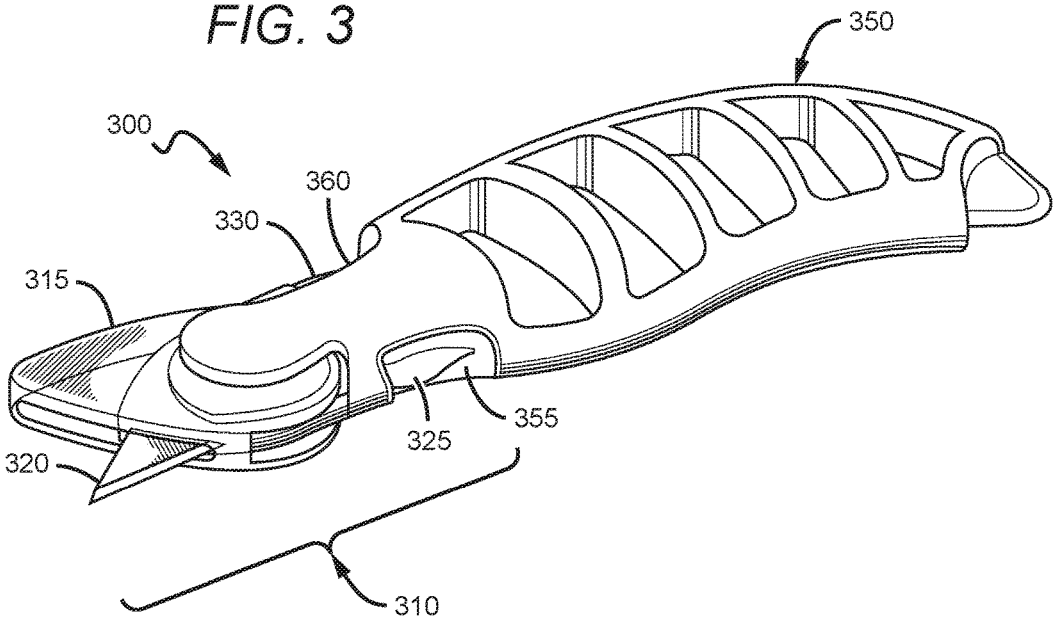

BLADE CARTRIDGES AND LOCKABLE SAFETY COVERS

FIELD OF THE INVENTION

The field of the invention is utility knives.

BACKGROUND

The background description includes information that may be useful in understanding the present invention. It is not an admission that any of the information provided herein is prior art or relevant to the presently claimed invention, or that any publication specifically or implicitly referenced is prior art.

Safety has been an important concern when using utility knives as many users inadvertently cut themselves with the exposed blades. Some efforts have been made to address this safety concern.

For example, U.S. Pat. No. 8,347,509 teaches a blade cartridge with a blade cover that defaults to a closed position in which the blade cover surrounds the otherwise exposed portion of a blade. A spring is used to push the blade cover into the closed position, and the blade cover remains in the closed position until pressure is applied to push the cover to an open configuration where the blade is exposed for use.

This and all other publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Unfortunately, the '509 Patent's blade cartridge and blade cover fails to address several other safety issues, for example, injuries that can occur from an inadvertent detaching of the cartridge or blade from a tool handle.

U.S. Pat. Nos. 7,475,480 and 8,099,868 each strive to solve this problem by featuring a flexing latch to secure the handle to the cartridge. While the cartridge is inserted into the handle, the latches flex into a strained position in order to fit into the receiving channel of the handle. Once the cartridge has been fully inserted into the handle, the latches then return to a relaxed, unstrained position by pushing through openings on either side of the handle. Such a latching mechanism is useful in securing the blade.

Unfortunately, the cartridge is at risk of inadvertent detachment from the handle because the latches are positioned on the handle at a place where users commonly squeeze their thumb and first finger together to grip and manipulate the tool.

Thus, there is still a need for improved and safer utility knives and utility knife components.

SUMMARY OF THE INVENTION

The following description includes information that may be useful in understanding the present invention. It is not an admission that any of the information provided herein is prior art or relevant to the presently claimed invention, or that any publication specifically or implicitly referenced is prior art.

The inventive subject matter provides apparatus, systems, and methods in which a utility knife includes a blade cover that is movable from a locked position to an unlocked position relative to at least one of a blade cartridge, a blade holder, and a tool handle. When the blade cover is in an unlocked position, the blade cover can advantageously be moved (e.g., rotate (partially or fully), pivot, slide, swivel, turn, bend, flex) from a blade covering configuration to a blade exposing configuration.

The blade cover could be biased towards the blade covering configuration, for example, via a spring, such that a force (e.g., from a cutting surface or a user) is required to move to the blade exposing configuration.

In some aspects, contemplated utility knives could comprise a cartridge that is coupled to or includes a blade, and a blade cover coupled to the cartridge. The cartridge could comprise a stem that extends from an end of the cartridge opposite the blade. The stem could include one or more flexible spring arms that each includes a locking member sized and dimensioned to be releasably received by a catch of a tool handle. Advantageously, the spring arms could be configured to flex in opposite directions and towards one another such that the cartridge could readily be removed from the tool handle when desired. Additionally or alternatively, the catches that receive the locking mechanisms could be positioned on top and bottom portions of the tool handle (when the tool is being used), such that unintentional release of the cartridge from the handle during use can be avoided.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1A illustrates a blade cartridge and cover of the inventive subject matter, wherein the cover is in a locked position.

FIG. 1B illustrates the blade cartridge and cover of FIG. 1A, wherein the cover is in an unlocked position.

FIG. 1C illustrates the blade cartridge and cover of FIGS. 1A-1B, wherein the cover is in a blade exposing configuration.

FIG. 2A illustrates another blade cartridge and cover of the inventive subject matter, wherein the cover is in an unlocked position and a blade covering configuration.

FIG. 2B illustrates the blade cartridge and cover of FIG. 2A, wherein the cover is in an unlocked position and a blade exposing configuration.

FIG. 3 illustrates a utility knife of the inventive subject matter.

DETAILED DESCRIPTION

Figure 4:
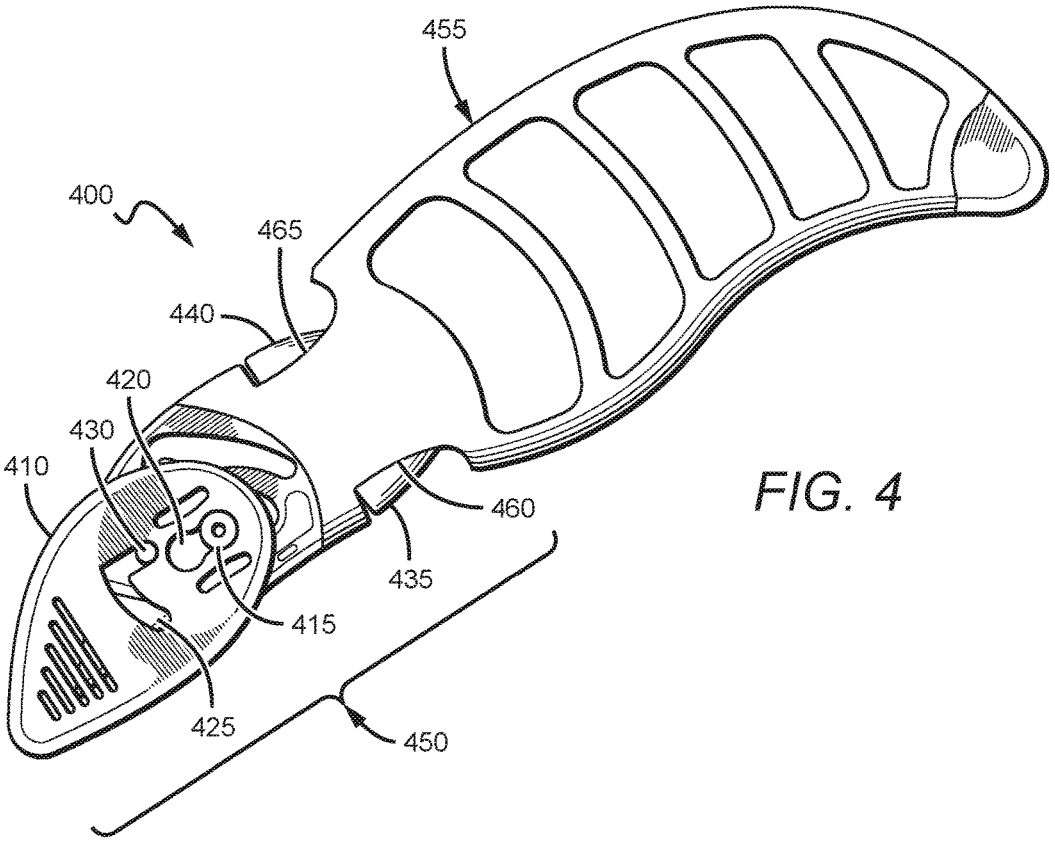
FIG. 4 illustrates another utility knife of the inventive subject matter.

The inventive subject matter provides utility knives with a safety cover that is movable from a locked position to an unlocked position (and vice versa), and from a biased unexposed blade configuration to an exposed blade configuration (and vice versa). The utility knives can include a cartridge for a blade and blade cover, and a tool handle that is configured to securely and releasably receive the cartridge.

The following discussion provides many example embodiments of the inventive subject matter. Although each embodiment represents a single combination of inventive elements, the inventive subject matter is considered to include all possible combinations of the disclosed elements.

Thus if one embodiment comprises elements A, B, and C, and a second embodiment comprises elements B and D, then the inventive subject matter is also considered to include other remaining combinations of A, B, C, or D, even if not explicitly disclosed.

FIGS. 1A-1C illustrate a utility knife cartridge 100 of the inventive subject matter. Cartridge 100 comprises blade holder or blade holder component 110, blade 65, stem 90, and blade cover 30. Blade holder 110 and stem 90 could be made from a single piece of material (e.g., injected molded plastic, metal). In other contemplated embodiments, blade holder 110 and stem 90 could be made from separate pieces of material.

Where a separate tool handle is not used with a cartridge of the inventive subject matter, stem 90 could be replaced with or otherwise include a handle. Here, cartridge 100 is one of many cartridges that can be used in combination with a tool handle (e.g., 350 of FIG. 3). In order to allow cartridge 100 to be releasably coupled to the tool handle, stem 90 includes a first arm 40 with a first stem locking member 40A, and a second arm 45 with a second locking member 45A. Each locking member is configured to mate with a catch of a tool handle as further described below.

Blade cover 30 is advantageously configured to move (e.g., slide) relative to the blade holder from a locked position, as shown in FIG. 1A, to an unlocked position, as shown in FIG. 1B. Blade holder 110 comprises a lock protrusion 50 that is configured to cooperate with blade cover's lock opening 55. This allows the blade cover 30 to be locked in a safe position that keeps the blade from being inadvertently exposed, regardless of whether or not the cartridge has been inserted into a tool handle.

Additionally, blade cover 30 is configured to move (e.g., rotate) relative to the blade holder and blade from a blade covering configuration, as shown in FIG. 1B, to a blade exposing configuration, as shown in FIG. 1C. Blade holder 110 comprises a movement protrusion 70 that is configured to cooperate with blade cover's angled channel 105 to allow for rotation of blade cover 30 when it is in an unlocked position.

Here, lock opening 55 and angled channel 105 are shown as extending through a thickness of blade cover 30. However, it should be appreciated that lock protrusion 50 and movement protrusion 70 could additionally or alternatively cooperate with recessed portions or grooves on an inner surface of blade cover 30.

Still further, while blade holder 110 is shown to have the lock and movement protrusions, and blade cover 30 is shown to have the lock opening and angled channel, it should be appreciated that one or more of the protrusions could be included on the blade cover, and one or more of the openings or channels could be included on the blade holder.

In the embodiment shown, lock opening 55 is peanut shaped, and includes a narrow central portion between two wider ends. Lock protrusion 50 can be positioned, sized and dimensioned to snugly fit through the narrow central portion when a force towards one of the wider ends is applied by a user. Viewed from another perspective, a user could use at least one of a thumb and forefinger to hold the blade cover and move it towards the stem 90 to unlock the blade cover. Additionally or alternatively, the user could move the blade cover towards the blade 65 to lock the blade cover.

One or more slots (e.g., 60) could be included on blade cover 30 to allow the central portion of lock opening 55 to widen and allow lock protrusion 50 to pass through. Additionally or alternatively, one or more slots could be included on blade cover that allows a user to see blade 65 (or other tool) when blade cover is in a blade covering configuration.

In some embodiments, the lock protrusion 50 could have a varying thickness, and include at least one thinner portion and at least one wider portion. The wider portion(s) could be wider than the narrow central portion of lock opening 55, and thus not sized and dimensioned to pass through the narrow central portion. The thinner portion(s) could be positioned further away from blade holder 110 than the wider portion, such that lock protrusion 50 could be pushed in, and the thinner portion could pass through the narrow central portion of lock opening 55. Additionally or alternatively, the thinner portion could be positioned closer to the blade holder such that the lock protrusion could be pulled out, and the thinner portion could pass through the narrow central portion.

When the blade cover is moved from a locked position (as shown in FIG. 1A) to an unlocked position (as shown in FIG. 1B), movement protrusion 70 could be positioned at a corner of channel 105 such that blade cover 30 can move from a blade covering configuration (as shown in FIG. 1B) to a blade exposing configuration (as shown in FIG. 1C). As illustrated in FIGS. 1A-1C, the channel 105 can include a first sub-channel and a second sub-channel. The movement protrusion 70 could move through first sub-channel when blade cover 30 moves between a locked position and an unlocked configuration. The movement protrusion 70 could move through the second curved sub-channel when blade cover 30 moves between a blade covering configuration and a blade exposing configuration.

In some embodiments, blade cover 30 could be biased towards the blade covering configuration (e.g., via a spring). An exemplary spring biasing mechanism is the curved spring carried in a groove and described in U.S. Pat. No. 8,099,868 to Votolato. When blade cover 30 is in an unlocked position, a user could apply a pressure to a portion of the blade cover, for example, via a cutting surface, and cause the blade to be exposed to apply a cut to the cutting surface (item to be cut). When the pressure is released (e.g., when the knife is moved away from a cutting surface), blade cover 30 could automatically move back to a blade covering configuration.

It should be appreciated that the locking feature (lock opening 55 and lock protrusion 50) can allow a user to repeatedly lock and unlock the cover with a simple movement. A user can simply grab the blade cover with a forefinger and thumb, and pull or push the blade cover slightly away from or towards the knife handle. This can prevent accidental exposure to the cartridge blade when the knife is not in use (e.g., when it is in a pocket of a user, is placed in a toolbox or left unattended, when the cartridge is being coupled to, or removed from, a tool holder.

It is contemplated that cartridge 100 could be replaced with another blade cartridge, for example, when blade 65 becomes dull. Additionally or alternatively, cartridge 100 could be replaced with a different tool cartridge (e.g., screw driver cartridge, saw cartridge, scraper cartridge). The different tool cartridges could be the same as utility knife cartridge 100, except that blade 65 is replaced with a different tool.

FIGS. 2A-2B illustrate another utility knife cartridge 200 of the inventive subject matter. Cartridge 200 includes blade holder 235 having a stem, blade 230, and a partially transparent blade cover 210. Cartridge 200 includes a lock opening and lock protrusion similar to those described in FIGS. 1A-1C. Cartridge 200 also includes slots 220A and 220B that provide some flexibility to blade cover 210.

Furthermore, cartridge 200 includes a movement protrusion 240 that cooperates with channel 215 to allow blade cover 210 to adjust between locked and unlocked positions, and between blade covering (closed) and blade exposing (open) configurations.

In some embodiments, a cartridge blade cover could default/be biased to a closed position in which the blade cover surrounds the otherwise exposed portion of a blade. A spring (e.g., a curved spring) could be included, which pushes the blade cover into the closed position. The blade cover could remain in the closed position until pressure is applied to push the cover to an open configuration where the blade is exposed for use.

Additionally or alternatively to a spring, cartridge 200 could include an elongated piece 245 that can bias the blade cover in the closed position. When blade cover 210 is moved to an open configuration by a cutting surface or other force, blade cover 210 can cause elongated piece 245 to flex to a strained position within open region 225 (as shown in FIG. 2B).

As discussed above, cartridges of the inventive subject matter could include stems that are configured to be releasably received by one or more tool handles of the inventive subject matter. FIG. 3 illustrates a utility knife 300, which includes a cartridge 310 releasably locked into place on tool handle 350.

Cartridge 310 includes a blade holder, blade 320, blade cover 315, and a stem that includes two flexible arms that include two locking members (325, 330). In one embodiment, the stem and flexible arms are configured such that considerable pressure is required to depress the two flexible arms. In another embodiment, only slight pressure is required to depress the two flexible arms. Further, in some embodiments, after pressure is released from the two flexible arms, the arms return back to their original positions. In a further embodiment, only when the two flexible arms are depressed is cartridge 310 able to fit into tool handle 350, while in another only one flexible arm must be depressed.

Tool handle 350 includes a first catch 355 sized and dimensioned to receive a first locking member (e.g., 40A, 325), and a second catch 360 sized and dimensioned to receive a second locking member (e.g., 45A, 330). In the embodiment shown, catch 355 is located on a bottom edge of knife 300, and catch 360 is located on a top edge of knife 300. When cartridge 310 is locked with tool handle 350, the two flexible arms can be flexed towards each other (away from their resting positions) to allow locking members 325 and 330 to snap into catches 355 and 360, respectively. From another perspective, the flexible arms of cartridge 310 could be configured such that, in a relaxed position, locking members 325 and 330 rest snugly and securely within catches 355 and 360.

The receiving end of the opening of the tool holder can be sized and dimensioned to receive the arms of cartridge 310 in a way that momentarily depresses those arms, allowing for locking members 325 and 330 to slide into the tool handle opening, and then to snap back to lock into place in catches 355 and 365 located on the vertical plane or spine of the handle.

When removing cartridge 310 for replacement, a user can simply squeeze or pinch the stem arms together via locking members 325 and 330, allowing cartridge 310 to be pulled out from tool handle 350. In some embodiments, the force required to depress the stem arms is great, while in others slight pressure is sufficient.

Cartridge 310 can further be configured such that, while inserting cartridge 310 into tool handle 350, cartridge 310 is shifted into a locked configuration where blade cover 315 cannot move in relation to blade 320. This can be accomplished, for example, by reversing the orientation of angled channel 105 such that a pushing motion along blade cover 315 toward tool handle 350 slides the lock protrusion along the angled channel into a locked conformation.

Cartridge 310 can further be configured such that, while removing cartridge 310 from tool handle 350, cartridge 310 is shifted into a locked configuration where blade cover 315 cannot move in relation to blade 320. This can be accomplished, for example, by using the orientation of angled channel 105 such that a pulling motion along blade cover 315 away from tool handle 350 slides the lock protrusion along the angled channel into a locked conformation.

Whereas known utility knives included spring arms protruding along the horizontal axis and perpendicular to the orientation of the blade, cartridges of the inventive subject matter can advantageously include flexible arms on the vertical plane, and in the same direction as the orientation of the blade. Viewed from another perspective, when knife 300 is used to make a cut, a user can grab left and right sides of the blade without inadvertently releasing the cartridge from the tool handle.

FIG. 4 illustrates another utility knife 400 of the inventive subject matter. Knife 400 includes stem 455 and cartridge 450. Cartridge 450 includes a blade holder, blade, blade cover 410, and two flexible arms including locking members 435 and 440. Stem 455 includes first and second catches 460 and 465, which are sized and dimensioned to block locking members 435 and 440 in place.

Cartridge 450 is similar to the cartridges shown in FIGS. 1A-1C and FIGS. 2A-2B, and includes mechanisms that allow blade cover 410 to move between locked and unlocked positions, and between closed and open configurations. As illustrated, blade cover 410 is in a locked position. A user could use his thumb and forefinger, a cutting surface, or any other suitable force to move blade cover 410 towards stem 455 such that locking protrusion 415 moves to an opposite end of lock opening 420 (unlocked position). This would position moving protrusion 430 within the corner of angled channel 425, and allow a user to rotate blade cover 410 to a blade exposing (open) configuration. Some contemplated channels allow blade cover 410 to rotate between 25-75 degrees, more preferably between 25-65 degrees, and even more preferably between 25-55 degrees.

Methods of making cartridges as described are also contemplated. A cartridge as detailed in FIGS. 1A-4 can be assembled by fixing a blade to a cartridge. The blade can be made of metal, plastic, ceramic, wood, bone, keratin, enamel, carbon, stone, obsidian, glass, diamond, or any other material suitable for cutting or applying directed pressure. Further, the blade may be straight, curved, round, angled, serrated, sharpened, dulled, or otherwise configured as appropriate for the desired use. The cartridge may be a single piece or the composite of several pieces. The pieces could be of the same material (e.g., injection molded plastic) or of a range of materials.

A cartridge as described above can be made by fixing a blade cover to the blade holder. The blade cover can be an integral part of the blade holder and can be made of the same material as the blade holder. For example, the blade cover and blade holder can be made of a single piece of flexible rubber. Further, the blade cover and blade holder can be made primarily of the same material as an integral piece, while the blade holder is further comprised of other components or materials. The blade cover and the blade holder can also be separate components, and can be made of different materials or the same material. The blade cover can be fixed to the blade holder by means that permit the blade cover to rotate (partially or fully), pivot, slide, swivel, turn, bend, flex or otherwise move in relation to the blade.

A cartridge as described above can also be made such that the blade cover and the blade holder are attached at a junction. The junction can be further configured such that a part of the junction prevents or allows the blade cover to move in relation to the blade, while another part of the junction provides the avenue or means for the blade cover to move in relation to the blade. The means of preventing or allowing movement, and restricting the direction of movement, of the blade cover in relation to the blade can be an integral part of the junction between the blade cover and the cartridge, or can be a separate component. Further, the components can be made of the same or different materials.

A cartridge as described above can further be made by fixing flexible arms to the blade holder. The flexible arms can be a separate component from the blade holder or can be an integral aspect of the blade holder. The flexible arms and blade holder can be made of the same material or of different materials. The flexible arms can be configured such that they depress while being inserted into a tool handle, and then return to an undepressed position once completely inserted into the tool handle.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cartridge for coupling with a handle, the cartridge comprising:

a handle-coupling member configured to reversibly mate with a cartridge-coupling member of the handle;

a blade and a blade cover;

a first protrusion about which the blade cover is movable between (a) a closed configuration in which the blade is covered and (b) an open configuration in which the blade is exposed; and a locking channel disposed in the blade cover, wherein the blade cover proximal to the locking channel is moveable about the first protrusion;

wherein (a) the blade cover is restrained from moving between the closed and open configurations when the first protrusion is in a first portion of the locking channel, and (b) the blade cover is movable between the closed and open configurations when the first protrusion is in a second portion of the locking channel; and wherein the locking channel has a narrowed portion between first and second wider portions, and wherein the first portion of the locking channel is the first wider portion and the second portion of the locking channel is the second wider portion.

2. The cartridge of claim 1, wherein the blade cover has a movement channel moveable about a second protrusion.

3. The cartridge of claim 2, wherein the first protrusion has a fixed position relative to the second protrusion.

4. The cartridge of claim 1, wherein the blade cover is biased towards the closed configuration.

5. The cartridge of claim 4, wherein the blade cover is biased towards the closed configuration by a spring.

6. The cartridge of claim 1, wherein the locking channel and first protrusion are configured such that the blade cover can slide closer to, and farther away from, the handle-coupling member.

7. The cartridge of claim 6, wherein the blade cover has a movement channel moveable about a second protrusion, and wherein the movement channel and the second protrusion are configured such that the blade cover can slide closer to, and farther away from, the handle-coupling member.

8. A utility knife having a handle, comprising:

a blade;

a blade cover having a first channel and a second channel; and an intermediate portion disposed between the blade and the handle, and having a first protrusion slidable within the first channel, and a second protrusion slidable within the second channel;

wherein the blade cover is movable relative to the first protrusion;

wherein the second channel has a curved portion and a linear portion, the curved portion oriented such that the second protrusion slides within the curved portion of the second channel when the blade cover rotates about the first protrusion, and the linear portion is oriented such that the second protrusion slides within the linear portion of the second channel when the blade cover slides closer to, and farther away from, the handle; and wherein the first channel has a narrowed portion between first and second wider portions, and wherein the second protrusion is (i) restrained from sliding in the curved portion of the second channel when the first protrusion is disposed in the first wider portion of the first channel, and (ii) slidable in the curved portion of the second channel when the first protrusion is disposed in the second wider portion of the first channel.

9. The utility knife of claim 8, wherein the intermediate portion has a handle-coupling member configured to reversibly mate with a receiving portion of the handle.

10. The utility knife of claim 8, wherein the blade cover is biased to a locked configuration.

* * * * *